United States Patent [19]

Biffi

[11] 4,047,323

[45] Sept. 13, 1977

[54] FLYING OBJECT

[76] Inventor: Egidio Biffi, 20062 Cassano d'Adda, Via Q. Divona, 29, Milan, Italy

[21] Appl. No.: 672,451

[22] Filed: Mar. 31, 1976

[30] Foreign Application Priority Data

July 3, 1975 Italy ..... 25061/75

[51] Int. Cl.[2] ..... A63H 27/04

[52] U.S. Cl. ..... 46/47; 46/59; 46/77

[58] Field of Search ..... 46/47, 51, 52, 77, 59

[56] References Cited

U.S. PATENT DOCUMENTS

| | | | |
|---|---|---|---|
| 2,826,862 | 3/1958 | Shapiro | 46/52 |
| 2,947,108 | 8/1960 | Dodd, Jr. et al. | 46/51 |
| 2,958,156 | 11/1960 | Schmal et al. | 46/51 |

*Primary Examiner*—Russell R. Kinsey
*Assistant Examiner*—Robert F. Cutting
*Attorney, Agent, or Firm*—Fleit & Jacobson

[57] ABSTRACT

A toy comprising, in combination, a flying object, connected through a cable, to a device handle for rotating said object; the handle incorporates an automatic cable unwinding and rewinding device actuated by centrifugal forces.

6 Claims, 2 Drawing Figures

FLYING OBJECT

This invention relates to a toy and particularly to a combination of a flying object connected through a cable to a drive handle incorporating an automatic cable unwinding and rewinding device, made so that the flying object can be freely rotated with the handle, and wherein the automatic unwinding device proportions the cable length, and accordingly the distance for the flying object from the handle, in accordance with the centrifugal force given to the object.

Through the combination referred to and due to the particular configuration of the drive handle, the play entertainment is rendered easier and safer since, as the effect retaining the object in a rotational state is released, the connecting cable is immediately retracted or rewound, thereby preventing the flying object from incorrectly colliding against obstacles or the like.

Generally, a flying object is provided, having any shape and connected through a cable to a handle fitted with a cable unwinding and rewinding device, said handle being provided with an idly rotating shaft, at one end thereof supporting a cable guiding means and a sprocket, the latter having the flying object connecting cable being wound up thereon, said sprocket being rotable relative to the shaft and under the action of a return spring tending to rotate the sprocket in the cable winding up direction, at one end said spring being connected to said sprocket and at the other end to said shaft.

The invention will now be hereinafter described in greater detail with reference to the figures of the acompanying drawings, in which.

Figure 1:
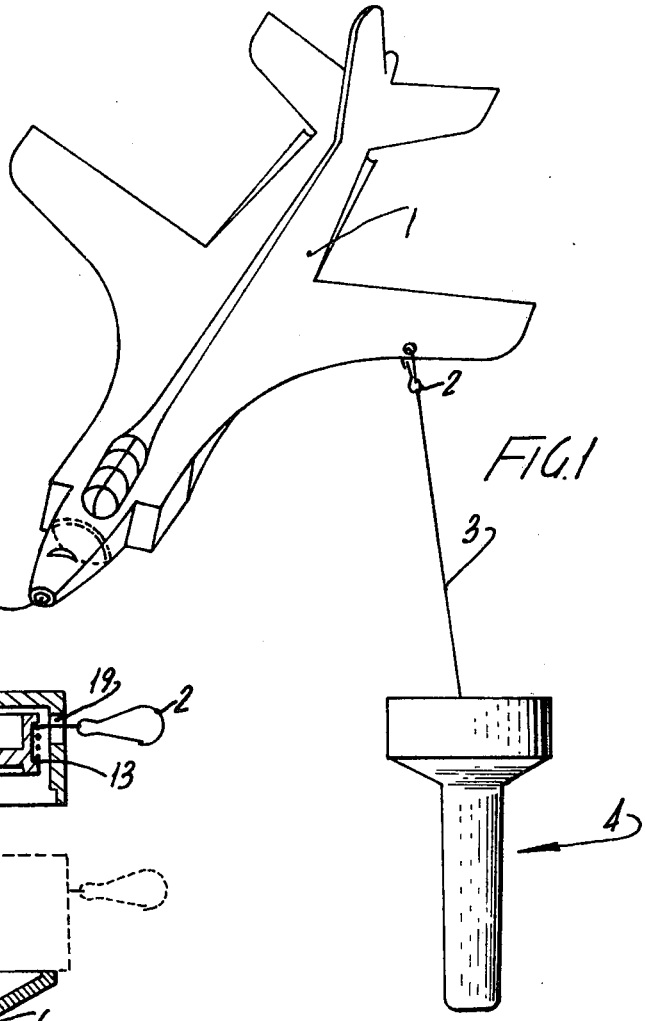
FIG. 1 is a perspective view of the toy assembly.

In the drawing, reference numeral 1 designates a general flying object, such as an airplane, which is connected through a spring catch 2 to a cable 3 made of steel, nylon or other material, automatically unwinding from and winding up in a drive handle generally designated at 4 in FIG. 1.

A general airplane is shown in FIG. 1 as flying object, but it is evident that the flying object could be given any shape according to requirements; for example, the flying object can be in the shape of a disc, bee, bird or other kind.

Figure 2:
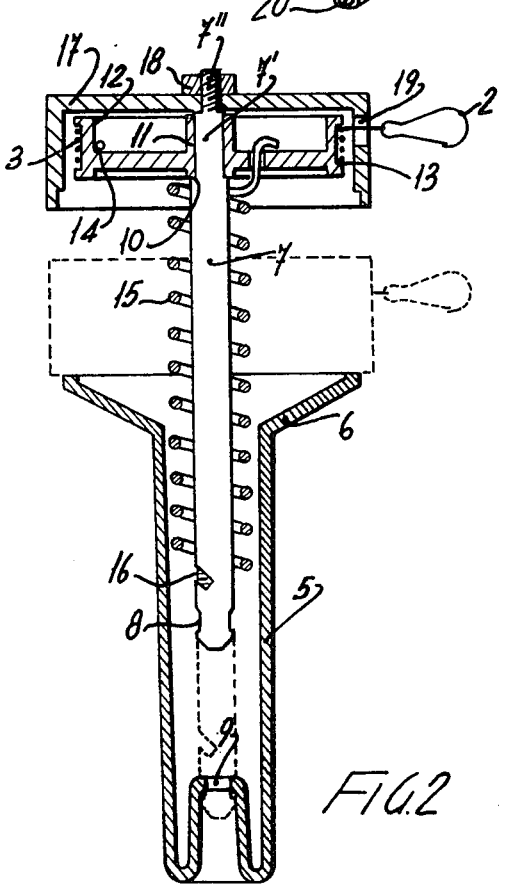
FIG. 2 is an exploded longitudinal sectional view of the drive handle having incorporated therein the automatic unwinding and rewinding device for the connecting cable to the flying object.

The drive handle having the automatic cable unwinding and rewinding device incorporated therein is particularly shown in the sectional view of FIG. 2.

As shown in FIG. 2, the handle substantially comprises a cylindrical portion 5 for hand gripping, at the top terminating with a flared or divergent portion 6. The handle portion 5 is internally hollow for accomodating a shaft 7, at the lower end of which a circular groove 8 snappingly engaging with a seat or bore 9 in the lower end of said portion 5. The size of the hooking bore 9 and circular groove 8 are such that shaft 7 is rotably carried idle and coaxial with the handle.

At the top and at some distance from its end, said shaft 7 has a minor diameter portion 7' defining a circular shoulder 10 against which the hub 11 of a rotating sprocket 12 for cable winding up bears, one end of the connection cable 3 to the flying object hooking thereto.

More particularly, sprocket 12 has an outer groove 13 formed therein, in which said cable 3 winds up and has one end thereof passed through a hole in the sprocket wall and secured, for example, by providing a knot 14 or in any other equivalent manner.

As above mentioned, sprocket 12 for winding up cable 3 is rotably carried relative to shaft 7. However, said sprocket 12 and shaft 7 are interconnected by a return spring 15 arranging all about said shaft 7 for the maximum length. At its upper end said spring 15 is connected to sprocket 12 and at its other lower end is fixedly hooked within a slit 16 formed laterally of shaft 7.

At the top, shaft 7 has a threaded end portion projecting from a cap 17 which by means of a nut 18 is secured to shaft 7. By means of a hole 19 thereof, said cap defines a guide means of cable 3 for winding up and unwinding operations.

Therefore, at the assembled condition of the handle, shaft 7 can continuously freely rotate relative to the handle, whereas sprocket 12 under the cable tractive action due to the centrifugal force exerted by flying object 1, when the latter is rotated, can rotate relative to said shaft 7, enabling cable 3 to unwind and emerge from aperture 19 in cap 17 for a length proportional to the rotational force given to flying object 1. Thus, as the cable is unwound, return spring 15 is loaded, balancing the effect of the centrifugal force and accordingly the tractive effect exerted on cable 3. Therefore, the larger the rotational force given to flying object 1 and higher the unwinding degree of cable 3 from sprocket 12.

As the rotation of object 1 about handle 4 decreases or ends, the effect of centrifugal force will decrease and hence the suitably preloaded return spring 15 will tend to rewind cable 3 on sprocket 12.

Advantageously, flying object 1 can incorporate a sound source which can be so configurated as to emit a whistle or a sound for air flow provided by the moving object.

Therefore, in the example shown in FIG. 1, an air intake 20 is provided at the airplane nose, which communicates with a cavity in said airplane nose, so shaped that due to the air flow incoming from intake 20, a whistle or sound is generated, tending for example to imitate the noise produced by a flying jet plane.

Evidently, the shape, arrangement and the manner of providing the sound generating device can be varied and adapted to the subject that the flying object can time by time represent or imitate.

What is claimed is:

1. A flying object assembly comprising, in combination, a cable, means for connecting one end of said cable to the flying object, a drive handle for rotating the flying object through said cable, an automatic cable winding means within said handle connected to the other end of said cable for yieldingly urging said cable into a wound condition within said handle, said cable winding means arranged to respond to the centrifugal force of the flying object acting oppositely to the urging force exerted on said cable by said cable winding means for unwinding of said cable from said handle to a length proportional to the centrifugal force exerted on said cable by the flying object.

2. An assembly according to claim 1 wherein said cable winding means comprises a shaft rotatably mounted within said drive handle so that the shaft rotates freely with respect to said drive handle, cable guide means on said shaft, a cable winding sprocket means rotatably mounted on said shaft for rotating with respect to said shaft, and a return spring for resiliently connecting said sprocket means to said shaft.

3. An assembly according to claim 2 wherein said return spring comprises a helical spring disposed in encircling relationship with said shaft and extending along the major portion of the length of said shaft, said shaft having an aperture, said spring having one end hooked to said sprocket means and secured at its other end to said aperture.

4. An assembly according to claim 2, wherein said cable guide means includes a cap having a side wall and secured to said shaft, said cap side wall having an opening for guidably accommodating said cable extending from said cable device to the flying object.

5. An assembly according to claim 1 wherein the flying object is provided with a sound source actuated by an air flow resulting from rotation of the flying object.

6. An assembly comprising, in combination, a flying object, a cable connected at one end to said flying object, a drive handle, a shaft disposed within said handle, said shaft being rotatably supported at one end in said handle for rotation relative to said handle and having its other end projecting from said handle, a cable winding sprocket rotatably mounted on the other end of said shaft for rotation relative to said shaft and connected to the other end of said cable, said sprocket having a circumferentially extending, peripheral winding groove for receiving said cable in a wound up condition, a helical return spring for said sprocket, said spring disposed in encircling relationship with said shaft within the interior of said handle, said spring being secured at one end to said cable winding sprocket and at its other end to said shaft, a cylindrical cap having a side wall and secured to the other end of said shaft in enclosing relationship with said cable winding up sprocket, said cap side wall having a hole for guidably accommodating said cable between said sprocket and said flying object.

* * * * *